US005779619A

United States Patent [19]

Borgström et al.

[11] Patent Number: 5,779,619

[45] Date of Patent: Jul. 14, 1998

[54] CENTRIFUGAL SEPARATOR

[75] Inventors: Leonard Borgström, Tyresö; Patrik Brehmer, Täby; Claes-Göran Carlsson; Peter Franzén, both of Tullinge; Claes Inge, Saltsjö-Duvnäs; Torgny Lagerstedt; Hans Moberg, both of Stockholm, all of Sweden

[73] Assignee: Alfa Laval AB, Lund, Sweden

[21] Appl. No.: 727,614

[22] PCT Filed: Apr. 20, 1995

[86] PCT No.: PCT/SE95/00437

§ 371 Date: Dec. 4, 1996

§ 102(e) Date: Dec. 4, 1996

[87] PCT Pub. No.: WO95/29013

PCT Pub. Date: Nov. 2, 1995

[30] Foreign Application Priority Data

Apr. 21, 1994 [SE] Sweden ..... 9401354

[51] Int. Cl.[6] ..... B04B 11/02

[52] U.S. Cl. ..... 494/56; 494/70

[58] Field of Search ..... 494/56, 57, 58, 494/59, 65, 68, 70, 85

[56] References Cited

U.S. PATENT DOCUMENTS

| | | | |
|---|---|---|---|
| 4,516,987 | 5/1985 | Niggemann | 494/56 X |
| 4,566,873 | 1/1986 | Toda | 494/56 X |
| 5,147,280 | 9/1992 | Carlsson et al. | 494/56 |
| 5,160,311 | 11/1992 | Inge et al. | 494/70 X |
| 5,171,205 | 12/1992 | Monkenbusch | 494/57 X |

FOREIGN PATENT DOCUMENTS

| | | |
|---|---|---|
| 0058353 | 8/1982 | European Pat. Off. . |
| 52029 | 2/1977 | Finland . |
| 729321 | 2/1934 | France . |
| 3940053 | 6/1991 | Germany . |

*Primary Examiner*—Charles E. Cooley
*Attorney, Agent, or Firm*—Fish & Richardson P.C.

[57] ABSTRACT

Centrifugal separator comprising a rotor, which forms an inlet and an outlet chamber (17) surrounding the rotational axis, in which a liquid present therein rotates around the rotational axis with a radially inwardly directed free cylindrical liquid surface. A stationary discharge device (21) extends in the outlet chamber (17) from the rotating liquid body radially inwardly to a central outlet (25) and forms a flow channel (26) with an inlet opening (23). In order to reduce the splashing around the discharge device (21) and reduce the danger of air admixture the discharge device (21) has a front contour (28) projected in a plane perpendicular to the rotational axis and directed towards the rotational direction and a rear contour (29) projected in this plane and directed in the rotational direction, which contour (28, 29) seen radially outwardly has a directional component in the rotational direction, the front contour (28) being so curved in said plane at the free liquid surface that it essentially has the same direction as the free liquid surface nearby and radially outside the free liquid surface.

18 Claims, 2 Drawing Sheets

CENTRIFUGAL SEPARATOR

FIELD OF THE INVENTION

The present invention concerns a centrifugal separator comprising a rotor, which is rotatable in a predetermined rotational direction around a rotational axis, and which forms an inlet for the liquid, which is to be centrifugally treated, and an outlet chamber for liquid separated in the rotor. The outlet chamber, which surrounds the rotational axis, is so designed that liquid present in the outlet chamber during operation forms a liquid body rotating around the rotational axis, the liquid body having a radially inwardly directed free liquid surface at a wanted radial level in the rotor. The centrifugal rotor also comprises a stationary discharge device, which is arranged in the outlet chamber and extends from the rotating liquid body radially inwardly to a central outlet. Inside itself the discharge device forms a flow channel with an inlet opening, which radially is located in the area where the free liquid surface is located during operation. During operation the inlet opening is located at least partly in the liquid body and via the flow channel the inlet opening is connected to the central outlet. The discharge device has a front contour projected in a plane perpendicular to the rotational axis and directed towards the rotational direction and a rear contour projected in this plane and directed in the rotational direction.

BACKGROUND OF THE INVENTION

Seen radially outwardly the contour of the discharge device in known separators of this kind is often directed towards the rotational direction, the inlet opening being directed towards the rotational direction. This allows one to obtain a high pressure in the liquid discharged through the outlet. However, surfaces of the discharge device, which during operation is located in the rotating liquid body and is directed towards the rotational direction, cause a considerable splashing of the separating liquid in the outlet chamber, which results in a great energy consumption and a great danger that the air or gas, which during operation is located radially inside the free liquid surface, can be entrained by the liquid, which leaves the outlet chamber through the flow channels in the discharge device.

Some liquid drops splashing around the discharge device are entrained in the rotation of the co-rotating air or gas volume radially inside the free liquid surface and are deposited onto the outside of the stationary discharge device. Along the outside of the discharge device liquid flows radially inwardly towards central parts of the discharge chamber where liquid might flow through central openings into another outlet chamber for another component separated out of the supplied liquid, which other component must not be contaminated by the separated liquid.

In a centrifugal separator known from EP A1 0 058 353 the discharge device is designed as a wing, which with internal flow channels extends radially outwardly into the rotating liquid body in such a way that a flow of liquid may take place along the discharge device with a relatively small flow resistance. By designing the discharge device in this manner the splashing of the separated liquid around the discharge device decreases and, thereby, the danger that air or gas is entrained in the flow of the separated liquid out of the separator decreases. However, the surfaces of the discharge device directed towards the rotational direction result in that quite a lot of splashing takes place during operation around the discharge device in spite of this design of the discharge device and that the danger of having air or gas admixed into the separated liquid also out of this centrifugal separator is relatively great.

SUMMARY OF THE INVENTION

One object of the present invention is to provide a centrifugal separator of the kind initially described, in which the above described splashing around the discharge device is slight and the danger of having air or gas entrained by the flow of the separated liquid out of the centrifugal separator is low, and in which the separated liquid can be discharged at low energy consumption. Another object of the invention is to provide a centrifugal separator, in which liquid does not flow radially inwardly along the outside of the discharge device so that the danger of having it passing into another outlet chamber for another component separated out of the supplied liquid, which component must not be contaminated by the separated liquid, is reduced or eliminated.

This is accomplished according to the present invention by a centrifugal separator of this kind having a discharge device, the front and rear contours of which are in a plane essentially perpendicular to the rotational axis seen radially outwardly and which have a directional component in the rotational direction along essentially their whole extensions, the front contour being so curved at the free liquid surface in said plane that it nearby and radially outside the free liquid surface essentially is directed in the rotational direction of the rotor.

Thus, the separated liquid in the rotating liquid body is brought to follow the outside of the discharge device gently and the splashing around the discharge device is strongly reduced and the above mentioned radially inwardly directed flow of liquid, which is located on the outside of the stationary discharge device radially inside the free liquid surface, is counteracted by the contact with the rotating air or gas flow radially inside the free liquid surface.

In a preferred embodiment the contours are so curved in said plane that their directional component in the rotational direction increases by increasing radius.

In a special embodiment the inlet opening has an extension in the rotational direction and is delimited and surrounded by an edge, which upstream has a front edge portion and downstream has a rear edge portion, at least the rear edge portion being located during operation radially outside the free liquid surface, and a straight line drawn through said edge portions forms an angle with a tangent to the free liquid surface at the inlet opening, the vertex of the angle being directed in the rotational direction and the angle being greater than 20° but smaller than 50°.

Advantageously, at least the portion of the discharge device which forms the inlet opening is arranged radially movable in such a way that the radial position of the inlet opening can be varied.

BRIEF DESCRIPTION OF THE DRAWINGS

In the following the invention will be described more closely with reference to the attached drawings, in which FIG. 1 schematically shows an axial section through a part of a centrifugal separator according to the invention.

DETAILED DESCRIPTION

Figure 1:
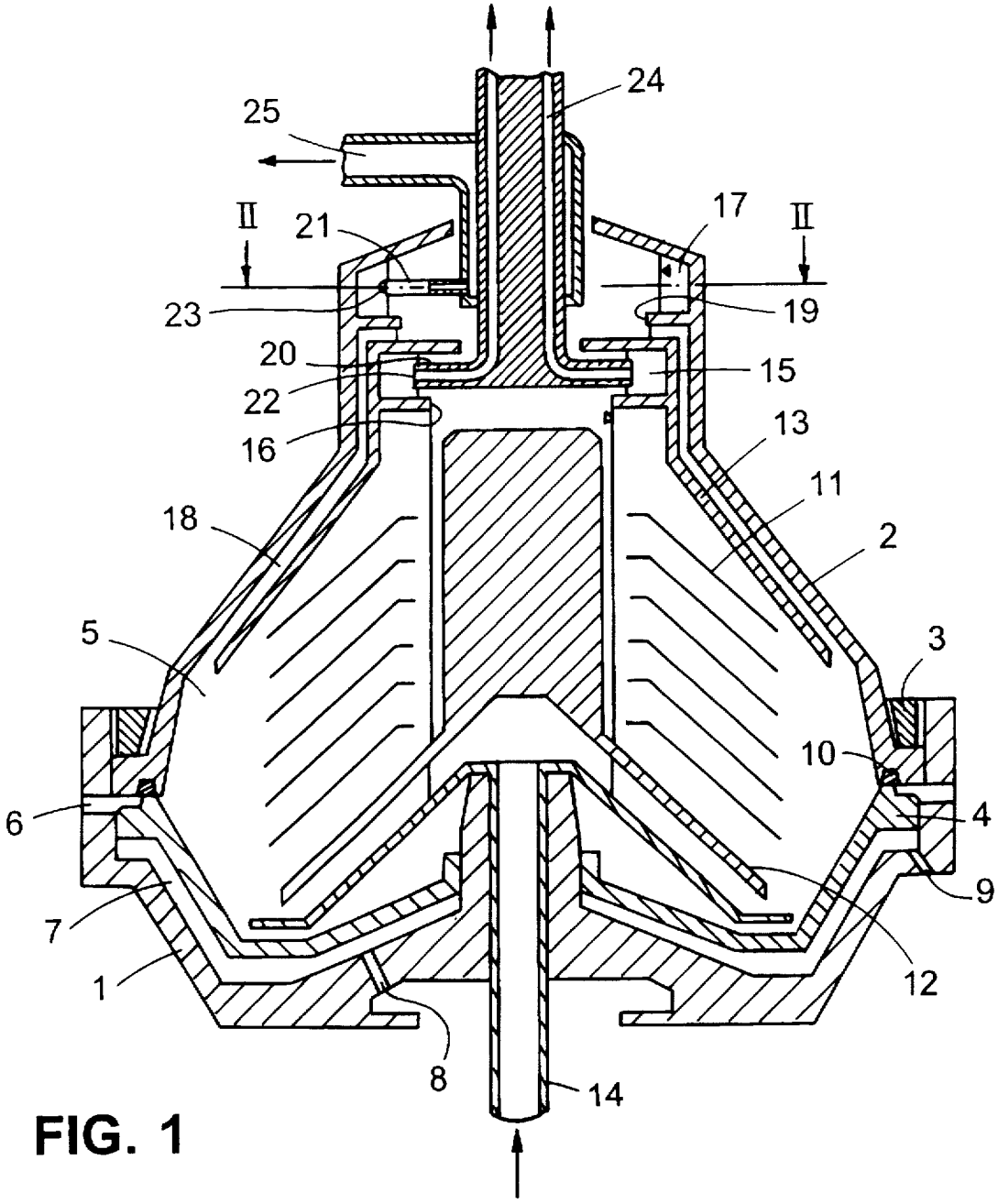

In FIG. 1 there is shown a part of a centrifugal separator comprising a rotor, which has a lower part 1 and an upper part 2, which are joined together axially by means of a locking ring 3. Inside the rotor there is arranged an axially movable valve slide 4. This valve slide 4 delimits together with the upper part 2 a separation chamber 5 and is arranged to open and close an outlet passage between the separation chamber 5 and the outlet opening 6 for letting out intermittently a component, which has been separated from a mixture supplied to the rotor and which is being collected at the periphery of the separation chamber 5. The valve slide 4 delimits together with the lower part 1 a closing chamber 7, which is provided with an inlet 8 and a throttled outlet 9 for a so called closing liquid. During the rotation of the rotor the valve slide 4 is pressed by the pressure from the closing liquid present in the closing chamber 7 during influence of the centrifugal force into sealing abutment against a gasket 10 arranged in the upper part 2.

Inside the separation chamber 5 a disc stack 11 consisting of a number of conical separation discs is arranged between a distributor 12 and a top disc 13. In the embodiment shown in FIG. 1 the rotor is mounted on a hollow shaft 14, through which the liquid to be centrifugally treated is supplied to the rotor. The top disc 13 forms at its upper end in the figure shown a centrally located first outlet chamber 15 for a specific lighter liquid component separated in the separation chamber 5. This first outlet chamber 15 communicates with the separation chamber 5 via a first overflow outlet 16, over which the specific lighter liquid component can flow out of the separation chamber 5.

The upper part of the rotor 2 forms a centrally located second outlet chamber 17, into which a specific heavier liquid component can flow from a radially outer portion of the separation chamber 5 via a passage 18 and a second overflow outlet 19.

In each outlet chamber there is arranged a respective stationary discharge device, a first discharge device 20 and a second discharge device 21. These discharge devices are provided with peripheral inlet openings, first inlet openings 22 and second inlet openings 23, respectively, which are connected to central outlets, a first outlet 24 and a second outlet 25, respectively. The discharge devices 20 and 21 extend mainly perpendicularly towards the rotational axis radially so far out that they during operation are partly located in a rotating liquid body located in the outlet chambers 15, 17, respectively.

Figure 2:
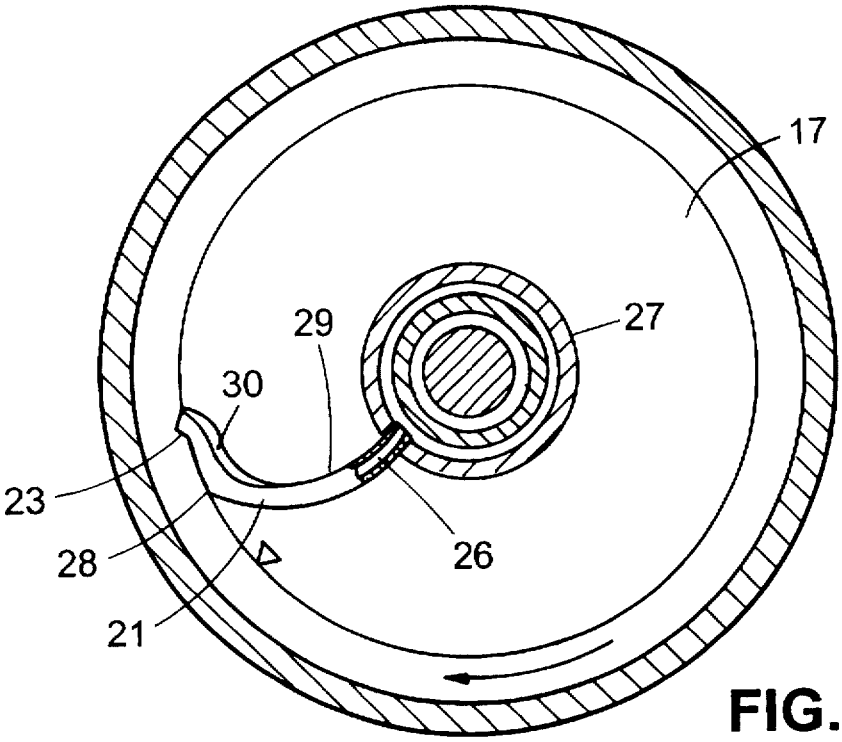
FIG. 2 shows a section along the line II—II in FIG. 1.

The design of the second discharge device 21 is disclosed more particularly by the section along the line II—II in FIG. 1 shown in FIG. 2. In the outlet chamber 17 the discharge device 21 extends with the flow channel 26 formed in the same from the free liquid surface, which in the figure is marked with a triangle, radially inwardly to the interior of an outlet tube 27.

At the free liquid surface the discharge device has an inlet opening 23, through which a liquid separated during operation and in the outlet chamber 17 rotating liquid can be discharged out of the outlet chamber 17. The rotational direction of the rotor, the rotating liquid body and the entrained air or gas flow is shown by the arrow drawn in the figure. Toward the rotational direction the discharge device 21 has a front contour 28 in a plane essentially perpendicular to the rotational axis and in the rotational direction the discharge device 21 has a rear contour 29 in this plane. Seen radially outwardly the contour 28 and 29 have a directional component in the rotational direction along essentially their whole extensions.

Along at least a portion of the rear contour 29 the discharge device has a fin 30, which extends radially along the discharge device 21 and in the rotation direction. This fin 30 increases the stiffness of the discharge device and has a stabilizing influence on the rotating and/or gas flow in the outlet chamber 17.

Figure 3:
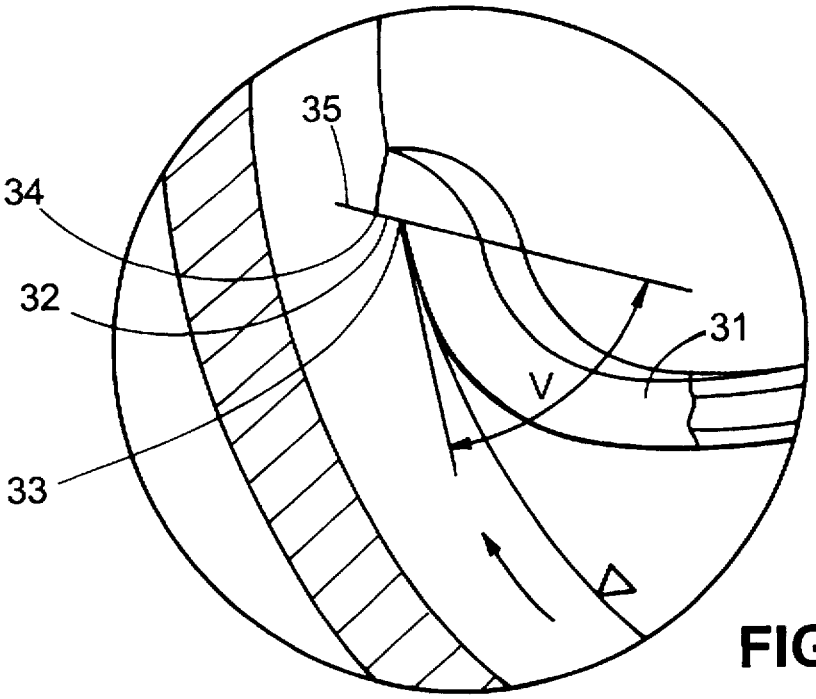
FIG. 3 shows an embodiment of a detail in FIG. 2.

In FIG. 3 there is shown a preferred embodiment of a radially outer portion of a discharge device 31 according to the invention. According to this embodiment the discharge device 31 has an inlet opening 32, which upstream is delimited by a front edge portion 33 and downstream is delimited by a rear edge portion 34. At least the rear edge portion 34 is located during operation radially outside the free liquid surface. A drawn straight line 35 connecting these edge portions 33 and 34 forms an angle V with a tangent to the free liquid surface at the inlet opening 32. This angle has the vertex directed in the rotational direction and is greater than 20° but smaller than 50°. The inlet opening then constitutes an interruption of the front contour of the discharge device, which still nearby and radially outside the free liquid surface essentially is directed in the rotational direction.

The centrifugal separator shown in the figures works in the following manner:

In connection with the starting of a centrifugal separator of this kind and bringing the rotor to rotate the separation chamber 5 is closed by supplying a closing liquid to the closing chamber 7 through the inlet 8. As soon as the separation chamber 5 is closed the liquid mixture, which is to be centrifugally treated, is supplied to the separation chamber 5 through the hollow shaft 14. When the rotor has reached the rotational speed of operation and the separation chamber 5 has been filled up, the components contained in the liquid mixture are separated by the influence of centrifugal forces acting on the same. The separation is then mainly taking place in the intermediate spaces between the conical discs in the disc stack 11. During separation a specific heavier liquid component is thrown radially out towards the periphery of the separation chamber 5 where it is accumulated, while a specific lighter liquid component flows radially inwards in these intermediate spaces.

If the centrifugally treated liquid mixture also contains specific heavy particles these are accumulated at the outermost periphery of the separation chamber 5.

The specific lighter liquid component flows over to the first outlet chamber 15 via the first overflow outlet 16, which, thereby, will be determining for the radial level of the free liquid surface in the separation chamber 5. The light liquid component is discharged under pressure out of the centrifugal rotor through a first outlet 24 via the first stationary discharge device 20, which in this case consists of a conventional pairing disc.

The specific heavier liquid component, which has been accumulated at the periphery of the separation chamber 5, flows radially inwards through the passage 18 and further via the overflow outlet 19 into the outlet chamber 17. Herein it forms a cylindrical liquid body which is kept in rotation. During operation the second discharge device 21 extends radially so far out in the second outlet chamber 17 that a minor part thereof is immersed in the rotating liquid body. However, a small portion of the discharge device 21 is immersed in the rotating liquid body so that at least a part of the inlet opening 23 or 32 is located in the rotating liquid. As a result, the friction between the outside of the second discharge device 21 and the rotating liquid body is low. Through the second discharge device 21 the specific heavier liquid component is discharged under pressure out of the centrifugal separator through a second outlet 25.

In the embodiment shown in FIG. 1 the discharge device 21 is arranged to discharge during operation a separated specific heavier liquid component. Of course, a discharge device 21 designed according to the present invention within the scope of the invention also can be arranged to discharge a separated specific lighter liquid component.

What is claimed is:

1. A centrifugal separator comprising a rotor, which rotor is rotatable in a predetermined rotational direction around a rotational axis and forms an inlet for liquid which is to be centrifugally treated, and an outlet chamber (17) for a liquid separated in the rotor, the outlet chamber (17) surrounding the rotational axis and being so designed that liquid present in the outlet chamber (17) during operation forms a liquid body, which has a radially inwardly directed free liquid surface at a preselected radial level in the rotor, rotating around the rotational axis, and a stationary discharge device (21) arranged in the outlet chamber (17), which discharge device extends from the rotating liquid body radially inwardly to a central outlet (25) and inside of said discharge device forms a flow channel (26) with an inlet opening (23,32), which radially is located in the area where the free liquid surface is located during operation, and which during operation is at least partly located in the liquid body and via the flow channel (26) is connected to the central outlet (25), and which discharge device (21) has a front contour (28) projected in a plane perpendicular to the rotational axis and directed towards the rotational direction of the rotor and a rear contour (29) projected in said plane and directed in the rotational direction of the rotor, wherein the front and rear contours (28, 29) viewed radially outwardly each have a directional component in the rotational direction of the rotor along essentially their whole extensions, the front contour (28) being so curved in said plane at the free liquid surface such that the front contour nearby and radially outside the free liquid surface essentially is directed in the rotational direction of the rotor.

2. The centrifugal separator according to claim 1, wherein the rear contour (29) is so curved in said plane that the directional component of the rear contour in the rotational direction of the rotor increases with increasing radius.

3. The centrifugal separator according to claim 1, wherein the front contour (28) is so curved that the directional component of the front contour in the rotational direction of the rotor increases with increasing radius.

4. The centrifugal separator according to claim 3, wherein the inlet opening (23, 32) has an extension in the rotational direction of the rotor.

5. The centrifugal separator according to claim 4, wherein the inlet opening (32) is delimited and surrounded by an edge, which upstream has a front edge portion (33) and downstream has a rear edge portion (34), at least the rear edge portion (34) being located during operation radially outside the free liquid surface and further wherein a straight line (35) drawn through said edge portions (33, 34) forms an angle (V) with a tangent to the free liquid surface at the inlet opening (32), which angle (V) has its vertex directed in the rotational direction of the rotor and is greater than 20° but less than 50°.

6. The centrifugal separator according to claim 5, wherein at least a portion of the discharge device (21, 31), which forms the inlet opening (23, 32), is radially movable in such a way that the radial position of the inlet opening (23, 32) can be varied.

7. The centrifugal separator according to claim 6, wherein the rear contour (29) is so curved in said plane that the directional component of the rear contour in the rotational direction of the rotor increases with increasing radius.

8. The centrifugal separator according to claim 7, wherein the inlet opening (23, 32) has an extension in the rotational direction of the rotor.

9. The centrifugal separator according to claim 4, wherein at least a portion of the discharge device (21, 31), which forms the inlet opening (23, 32), is radially movable in such a way that the radial position of the inlet opening (23, 32) can be varied.

10. The centrifugal separator according to claim 3, wherein at least a portion of the discharge device (21, 31), which forms the inlet opening (23, 32), is radially movable in such a way that the radial position of the inlet opening (23, 32) can be varied.

11. The centrifugal separator according to claim 1, wherein the inlet opening (23, 32) has an extension in the rotational direction of the rotor.

12. The centrifugal separator according to claim 11, wherein the inlet opening (32) is delimited and surrounded by an edge, which upstream has a front edge portion (33) and downstream has a rear edge portion (34), at least the rear edge portion (34) being located during operation radially outside the free liquid surface and further wherein a straight line (35) drawn through said edge portions (33, 34) forms an angle (V) with a tangent to the free liquid surface at the inlet opening (32), which angle (V) has its vertex directed in the rotational direction of the rotor and is greater than 20° but less than 50°.

13. The centrifugal separator according to claim 12, wherein at least a portion of the discharge device (21, 31), which forms the inlet opening (23, 32), is radially movable in such a way that the radial position of the inlet opening (23, 32) can be varied.

14. The centrifugal separator according to claim 11, wherein at least a portion of the discharge device (21, 31), which forms the inlet opening (23, 32), is radially movable in such a way that the radial position of the inlet opening (23, 32) can be varied.

15. The centrifugal separator according to claim 1, wherein at least a portion of the discharge device (21, 31), which forms the inlet opening (23, 32), is radially movable in such a way that the radial position of the inlet opening (23, 32) can be varied.

16. A discharge device for a centrifugal separator, the separator having a rotor, which is rotatable in a predetermined rotational direction around a rotational axis, and which forms an inlet for liquid which is to be centrifugally treated, and an outlet chamber (17) for a liquid separated in the rotor, the outlet chamber (17) surrounding the rotational axis and being so designed that liquid present in the outlet chamber (17) during operation forms a liquid body, which has a radially inwardly directed free liquid surface at a preselected radial level in the rotor, rotating around the rotational axis, the discharge device (21) intended to be arranged in the outlet chamber (17) extending from the rotating liquid body radially inwardly to a central outlet (25) and inside of said discharge device forms a flow channel (26) with an inlet opening (23, 32), which radially is located in the area where the free liquid surface is located during operation, and which during operation is at least partly located in the liquid body and via the flow channel (26) is connected to the central outlet (25), and which discharge device (21) has a front contour (28) projected in a plane perpendicular to the rotational axis and directed towards the rotational direction of the rotor and a rear contour (29) projected in said plane and directed in the rotational direction of the rotor, wherein the front and rear contours (28, 29) viewed radially outwardly each have a directional component in the rotational direction of the rotor along essentially their whole extensions, the front contour (28) being so curved in said plane at the free liquid surface such that the front contour nearby and radially outside the free liquid surface essentially is directed in the rotational direction of the rotor.

17. The discharge device according to claim 16, wherein the front contour (28) is so curved that the directional component of the front contour in the rotational direction of the rotor increases with increasing radius.

18. The discharge device according to claim 16, wherein the inlet opening (23, 32) has an extension in the rotational direction of the rotor and is delimited and surrounded by an edge, which upstream has a front edge portion (33) and downstream has a rear edge portion (34), at least the rear edge portion (34) being located during operation radially outside the free liquid surface and further wherein a straight line (35) drawn through said edge portions (33, 34) forms an angle (V) with a tangent to the free liquid surface at the inlet opening (32), which angle (V) has its vertex directed in the rotational direction of the rotor and is greater than 20° but less than 50°.

* * * * *

UNITED STATES PATENT AND TRADEMARK OFFICE

CERTIFICATE OF CORRECTION

PATENT NO. : 5,779,619

DATED : 07/14/98

INVENTOR(S) : Borgstrom et al.

It is certified that error appears in the above-identified patent and that said Letters Patent is hereby corrected as shown below:

On the title page, after 54, delete "Centrifugal Separator" and insert --Discharge Device for a Centrifugal Separator--.

Col. 3, line 63, change "contour" to --contours--.

Col. 4, line 1, change "rotation" to --rotational--.

Signed and Sealed this

Seventeenth Day of November, 1998

*Attest:*

*Attesting Officer*

BRUCE LEHMAN

*Commissioner of Patents and Trademarks*